US009756956B1

(12) United States Patent
Pekkinen

(10) Patent No.: US 9,756,956 B1
(45) Date of Patent: Sep. 12, 2017

(54) MATTRESS WITH INFLATABLE LUMBAR SUPPORT

(71) Applicant: Hannu Pekkinen, Toronto (CA)

(72) Inventor: Hannu Pekkinen, Toronto (CA)

( * ) Notice: Subject to any disclaimer, the term of this patent is extended or adjusted under 35 U.S.C. 154(b) by 129 days.

(21) Appl. No.: 14/592,273

(22) Filed: Jan. 8, 2015

Related U.S. Application Data

(63) Continuation-in-part of application No. 13/298,011, filed on Nov. 16, 2011, now abandoned.

(51) Int. Cl.

| | |
|---|---|
| ***A47C 27/14*** | (2006.01) |
| ***A47C 21/04*** | (2006.01) |
| ***A47C 27/08*** | (2006.01) |
| ***A47C 27/18*** | (2006.01) |

(52) U.S. Cl.
CPC ..... *A47C 27/142* (2013.01); *A47C 21/048* (2013.01); *A47C 27/081* (2013.01); *A47C 27/18* (2013.01)

(58) Field of Classification Search
CPC ... A47C 27/142; A47C 27/144; A47C 21/048; A47C 27/081; A47C 27/18; A47C 7/748; A47C 7/746; A47C 21/046; A47C 7/46; A47C 7/467; B60N 2/665; B60N 2/5685
See application file for complete search history.

(56) References Cited

U.S. PATENT DOCUMENTS 4,335,725 A * 6/1982 Geldmacher ..... A61F 7/007 219/202
4,591,693 A * 5/1986 Pike ..... A47C 21/048 219/201
4,617,690 A 10/1986 Grebe
4,697,064 A * 9/1987 Altmann ..... B60N 2/5685 219/202
4,723,329 A * 2/1988 Vaccaro ..... A47C 15/006 441/129
4,791,687 A * 12/1988 Iwase ..... A47C 20/00 5/708
4,837,879 A 6/1989 Parnham
4,876,756 A 10/1989 Vaccaro
4,928,335 A * 5/1990 Pedrow ..... A47G 9/10 5/421
4,981,131 A * 1/1991 Hazard ..... A47C 4/54 128/118.1
5,113,539 A 5/1992 Strell
D384,852 S * 10/1997 Koshaba ..... 5/632
5,785,669 A * 7/1998 Proctor ..... A47C 7/425 297/284.6
5,815,862 A * 10/1998 Rygiel ..... A47C 27/081 5/632
5,819,348 A 10/1998 Ryan
6,148,461 A 11/2000 Cook et al.
(Continued)

*Primary Examiner* — Eric Kurilla
(74) *Attorney, Agent, or Firm* — Robert C. Montgomery; Montgomery Patent & Design, LLP

(57) ABSTRACT

A mattress includes an inflatable lumbar support spanning across a top surface of the mattress in a position corresponding to the lumbar back area of a user when in a sleeping position. The apparatus further utilizes an electrical pump to inflate the tube to a desired firmness. A means to heat the tube for additional comfort and therapeutic benefit is also provided. The means to heat the tube as well as the inflatable connection are capable of being removable to enable repositioning or portability of the tube and means to heat the tube.

7 Claims, 8 Drawing Sheets

(56) References Cited

U.S. PATENT DOCUMENTS

| | | | | |
|---|---|---|---|---|
| 6,357,066 | B1 * | 3/2002 | Pierce | A61B 6/0442 5/710 |
| 7,360,266 | B2 * | 4/2008 | Kasatshko | A47C 4/54 297/452.41 |
| 7,437,789 | B2 * | 10/2008 | Thompson | A47C 7/467 5/626 |
| 8,701,230 | B2 * | 4/2014 | Zerhusen | A63B 26/003 5/612 |
| 8,978,185 | B1 * | 3/2015 | Holbrook | A47C 27/002 5/731 |
| 9,033,416 | B1 * | 5/2015 | Vanderhorst | A47C 7/46 297/230.1 |
| 2002/0144343 | A1 * | 10/2002 | Kuiper | A61G 7/001 5/81.1 R |
| 2003/0045824 | A1 * | 3/2003 | Murphy | A61F 5/01 602/32 |
| 2004/0026405 | A1 * | 2/2004 | Alvite | H05B 3/342 219/486 |
| 2012/0272450 | A1 * | 11/2012 | Pittman | A47C 17/80 5/119 |
| 2016/0136385 | A1 * | 5/2016 | Scorcioni | A61M 21/02 600/26 |

* cited by examiner

MATTRESS WITH INFLATABLE LUMBAR SUPPORT

RELATED APPLICATIONS

The present invention is a Continuation-in-part and claims the benefit of U.S. patent application Ser. No. 13/298,011, filed on Nov. 16, 2011, which claimed the benefit of U.S. Provisional Application No. 61/414,049 filed on Nov. 16, 2010, the entire disclosures of which are incorporated herein by reference.

FIELD OF THE INVENTION

The present invention relates generally to an inflatable mattress, and in particular, to a mattress comprising an inflatable lumbar support section.

BACKGROUND OF THE INVENTION

Mattresses are utilized for rest or sleeping purposes. Many people who utilize mattresses have back problems which require additional support. Various devices to support the back when lying on a mattress are known.

A common problem with theses devices is the lack of adjustability with the support. Furthermore with all the devices, a soothing feature is not utilized.

Various attempts have been made to provide mattresses with lumbar support. Examples of these attempts can be seen by reference to several U.S. patents. U.S. Pat. No. 4,837,879, issued in the name of Parnham, describes a mattress having lumbar support.

U.S. Pat. No. 4,876,756, issued in the name of Vaccaro, describes an air mattress with posture support.

U.S. Pat. No. 5,819,348, issued in the name of Ryan, describes a maternity mattress with inflatable abdominal support.

While these devices fulfill their respective, particular objectives, each of these references suffer from one or more disadvantages. Many are not suited to provide an adjustable and soothing support. Accordingly, there exists a need for a mattress without the disadvantages as described above. The development of the present invention substantially departs from the conventional solutions and in doing so fulfills this need.

SUMMARY OF THE INVENTION

The inventor has recognized the aforementioned inherent problems and lack in the art and observed that there is a need for a mattress with lumbar support.

Accordingly, it is an object of the present embodiments of the invention to solve at least one (1) of these problems. The inventor has addressed this need by developing a mattress with lumbar support which also offers soothing features.

To achieve the above objectives, it is an object of the present invention to provide a mattress with enhanced integral lumbar support.

Another object of the present invention is to provide a mattress assembly.

Yet still another object of the present invention is to provide the mattress assembly with an inflatable tube to provide lumbar or lower spine support. The inflatable tube in another embodiment is capable of being removably positioned within the mattress assembly.

Yet still another object of the present invention is to provide a vent valve to release air or prohibit air from escaping.

Yet still another object of the present invention is to provide a control module.

Yet still another object of the present invention is to provide the control module with an air pump control panel and an electric blanket control panel.

Yet still another object of the present invention is to provide an electrical air pump to inflate the inflatable tube. In another embodiment, the inflatable tube is removably connected to said electrical air pump.

Yet still another object of the present invention is to provide the control panel further comprises an air switch, a pressure display, and a vent valve.

Yet still another object of the present invention is to provide power via a power plug.

Yet still another object of the present invention is to provide an electric blanket panel further providing heating elements to warm the lumbar region. In another embodiment, the electric blanket panel is capable of being removably positioned within the mattress assembly.

Yet still another object of the present invention is to provide an electric blanket control panel to control the heating elements. The electric blanket panel is capable of being removably connected to said electric blanket control panel.

Yet still another object of the present invention is to provide a method of utilizing the device that provides a unique means of positioning the mattress, inserting the power plug, closing the vent valve, inflating the inflatable tube, activating the electric blanket panel, and resting or sleeping upon the mattress.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
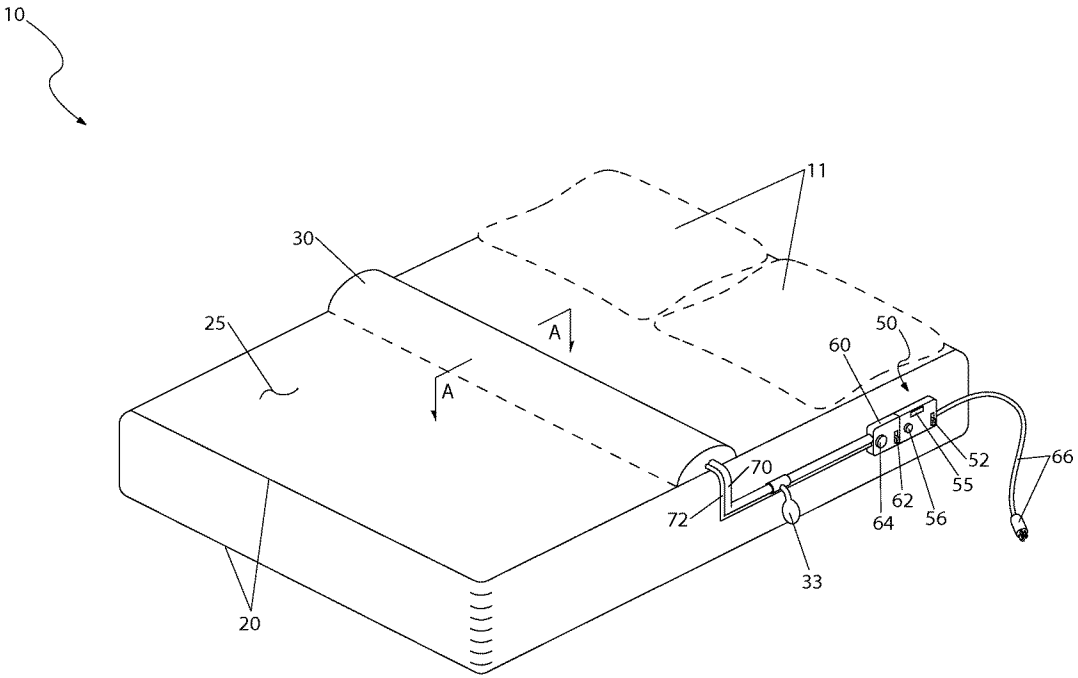
FIG. 1 depicts a perspective view of a mattress with inflatable lumbar support 10, according to a preferred embodiment.

10 mattress with inflatable lumber support
11 pillow
20 mattress assembly
21 top padding
22 inner padding
25 top fabric panel
26 bottom fabric panel
30 inflatable tube
33 manual air pump
38 electric blanket panel
39 heating element
50 control module
51 air pump
52 air pump control panel
54 air switch
55 digital display
56 relief valve
57 pressure sensor
60 electric blanket control panel
62 electric blanket switch
64 temperature dial
66 power plug
70 air tube
72 wire
100 user
125 fabric cover
130 portable inflatable tube
132*a* first hook-and-loop section
132*b* second hook-and-loop section
134*a* first quick disconnect plug
134*b* second quick disconnect plug

DETAILED DESCRIPTION OF THE PREFERRED EMBODIMENT

Figure 4:
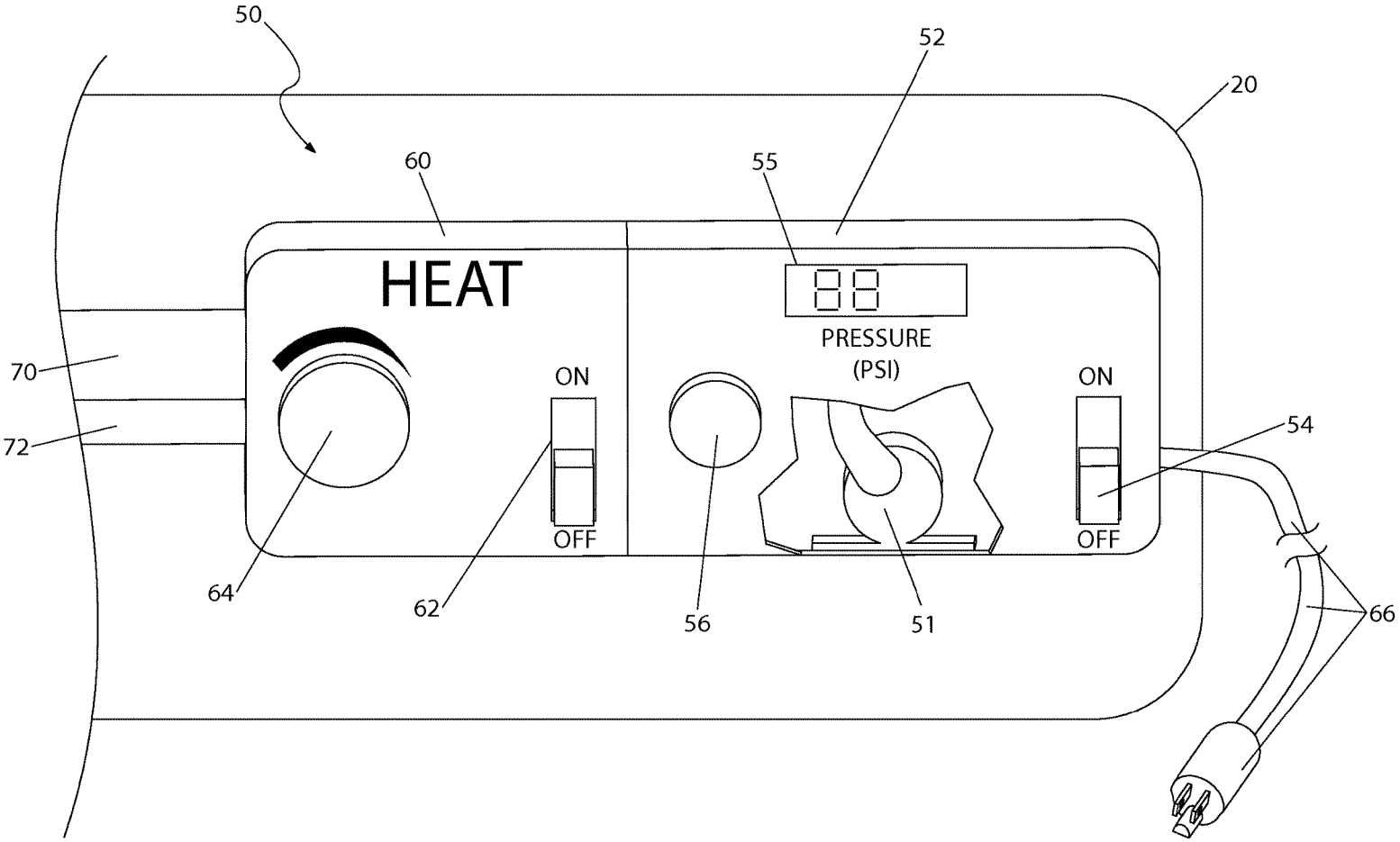
FIG. 4 depicts a close-up view of a control module portion 50 of the mattress with inflatable lumbar support 10, according to the preferred embodiment.
Figure 5:
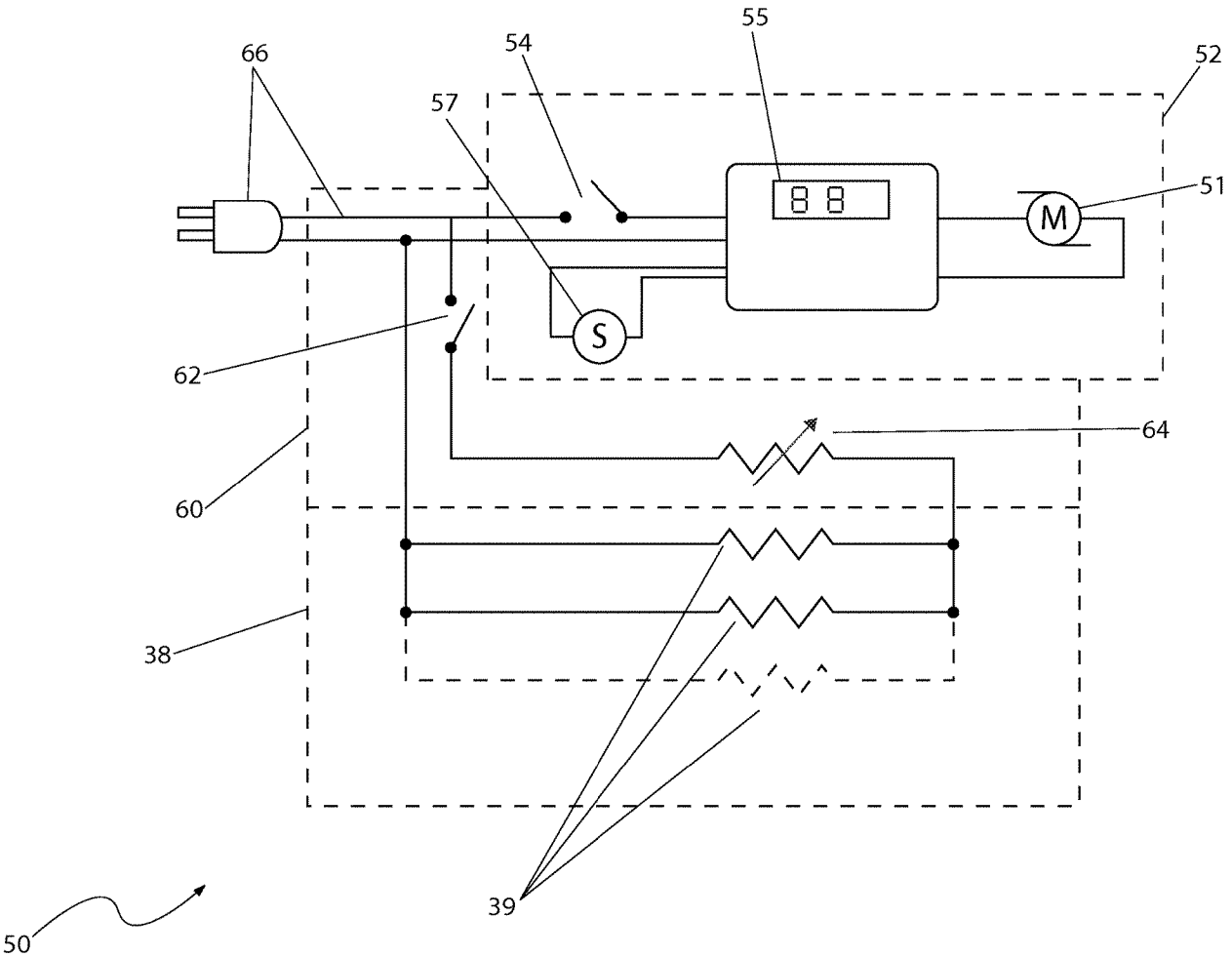
FIG. 5 depicts an electrical block diagram of the control module portion 50 of the mattress with inflatable lumbar support 10, according to the preferred embodiment.
Figure 6:
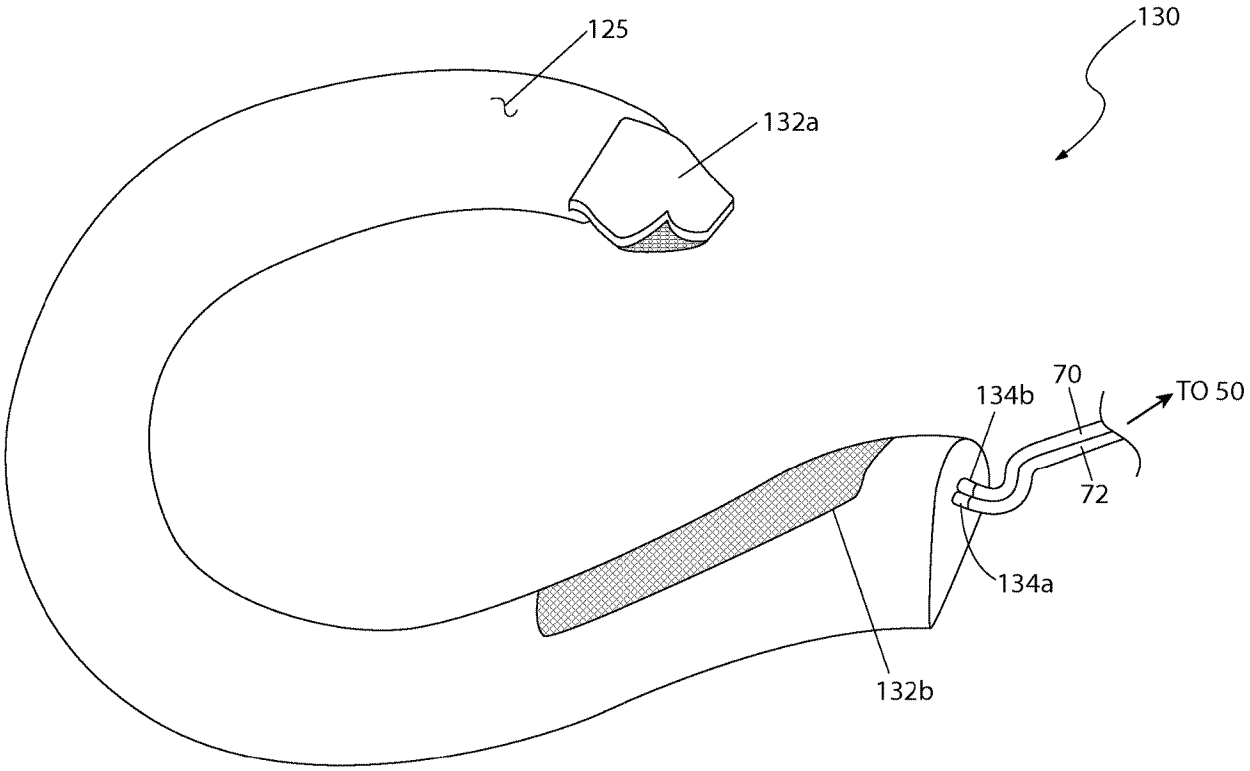
FIG. 6 depicts a perspective view of a portable inflatable tube embodiment 130, according to an alternate embodiment.
Figure 7:
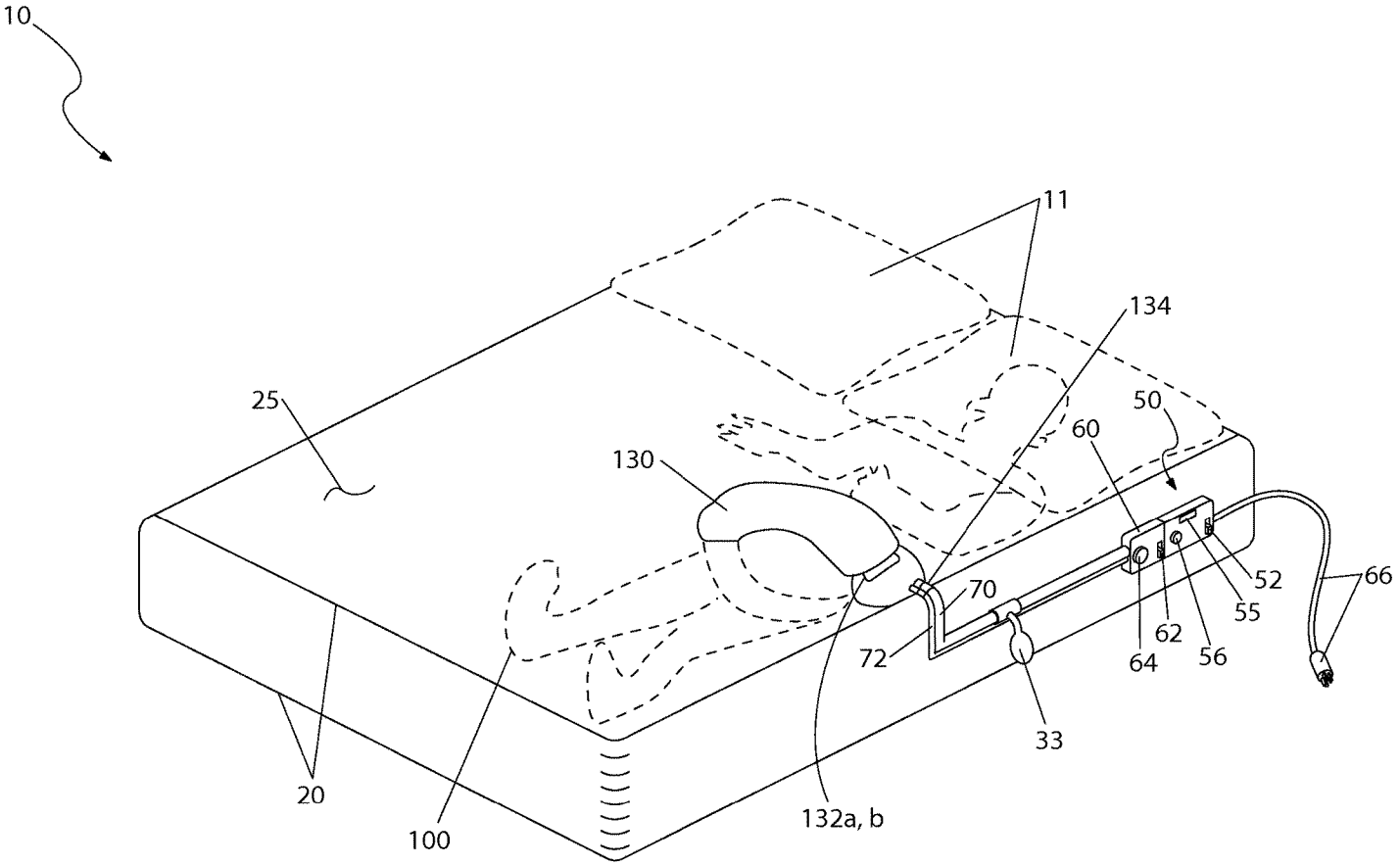
FIG. 7 depicts an environmental view of the portable inflatable tube embodiment 130, according to an alternate embodiment; and, FIG. 8 depicts a sectional view of the portable inflatable tube embodiment 130, according to an alternate embodiment.
Figure 8:
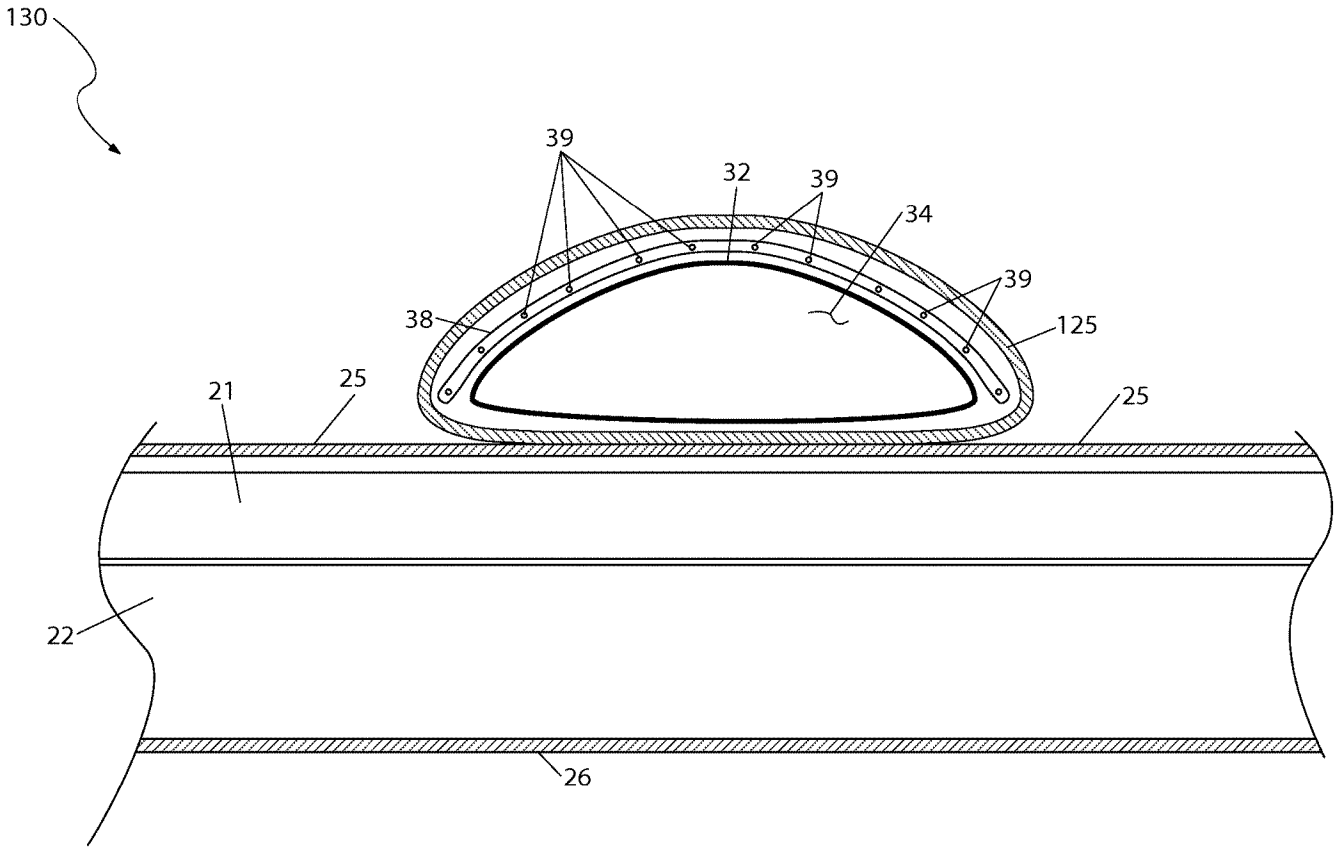

The best mode for carrying out the invention is presented in terms of its preferred embodiment, herein depicted within FIGS. 1 through 5 and in terms of an alternate portable embodiment 130, herein depicted within FIGS. 6 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Having recognized the abovementioned problems, the inventor observed there remains a need for a mattress 20 which provides adjustable lumbar support for a user's back. The development of a mattress with inflatable lumbar support (herein referred to as an apparatus) 10 solves these problems and fulfills this need. The apparatus 10 provides a mattress 20 with enhanced integral lumbar support 30. The apparatus 10 provides relief to individuals who suffer from lumbar or lower spine back problems.

Figure 2:
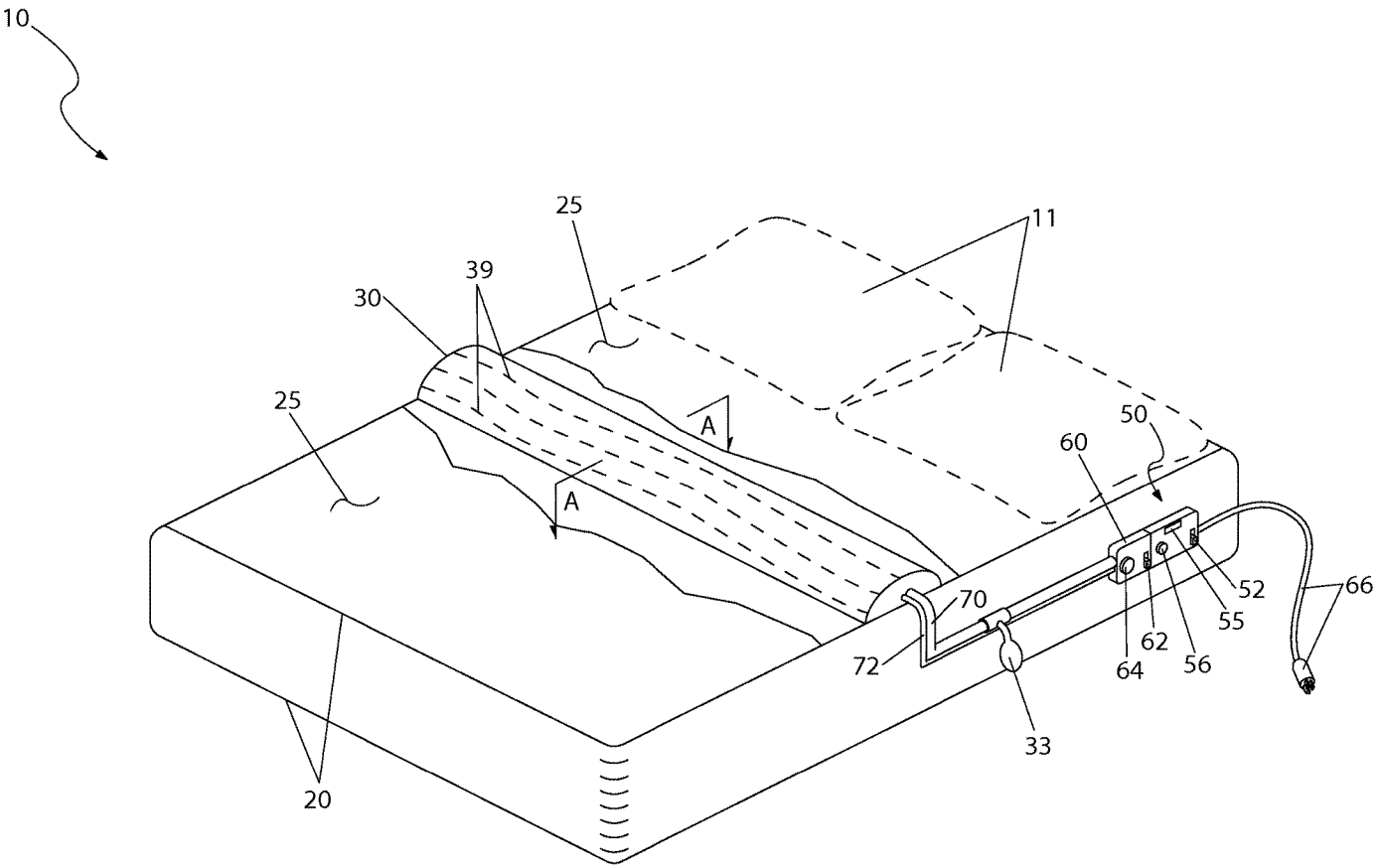
FIG. 2 depicts a partial cut-away view of the mattress with inflatable lumbar support 10 depicting an inflatable tube portion 30, according to the preferred embodiment.

Referring now to FIGS. 1 and 2, perspective and cut-away views of the apparatus 10, according to the preferred embodiment of the present invention, are disclosed. The apparatus 10 comprises a mattress assembly 20 comprising conventional internal construction which provides an integral lateral inflatable tube 30 onto which an occupant may lay his/her lower back area upon for resting or sleeping. The mattress assembly 20 may retain various blankets, pillows 11, or the like in a conventional manner to provide comfort to the user. The mattress 20 comprises standard sizes such as single, double, queen, and king sizes and may be placed upon a bed frame, the floor, or the like to accommodate an individual's needs and capacities (also see FIG. 3).

The inflatable tube 30 provides lumbar or lower spine support to individuals whom utilize the apparatus 10 and is to be positioned between an upper fabric panel 25 and top padding 21 portions of the mattress assembly 20. Said inflatable tube 30 is to be oriented across a width of said mattress assembly 20 at a position which corresponds to the lumbar region of the occupant. When inflated, said inflatable tube 30 comprises an ovular or semi-circular cross-sectional shape so as to apply pressure to the lumbar region of an occupant. When deflated, said inflatable tube 30 comprises a flat and level shape allowing the mattress assembly 20 to be utilized in like manner as a standard mattress.

The mattress assembly 20 provides an attachment means to a control module 50 along a side surface being adjacent to a head portion of said mattress assembly 20.

Said control module 50 further comprises an air pump control panel 52 and an electric blanket control panel 60 along a front surface. The inflatable tube 30 is inflated via an integral electrical air pump 51 mounted within the control module 50, or may be alternately inflated using a manual air pump 33 when desired, or during periods when electrical power is not available. Compressed air from the air pump 51 is in turn conveyed to an end portion of the inflatable tube 30 via an interconnecting air tube 70. Said air pump control panel 52 further comprises an air switch 54, a pressure display 55, and a vent valve 56 (also see FIG. 4). Electrical power is supplied to the air pump 51 via a power plug 66 which is plugged into an AC household outlet, yet other means of supplying current may be utilized without limiting the scope of the apparatus 10.

The mattress assembly 20 further comprises a rectangularly-shaped electric blanket panel 38 being positioned directly above the inflatable tube 30 further comprising a plurality of heating elements 39 being arranged in a conventional parallel manner to selectively provide warmth to the lumbar region of the user's back when desired. The heating elements 39 are to be activated and deactivated via an electric blanket control panel 60 which is location upon the front surface of the control module 50 (see FIG. 4).

Figure 3:
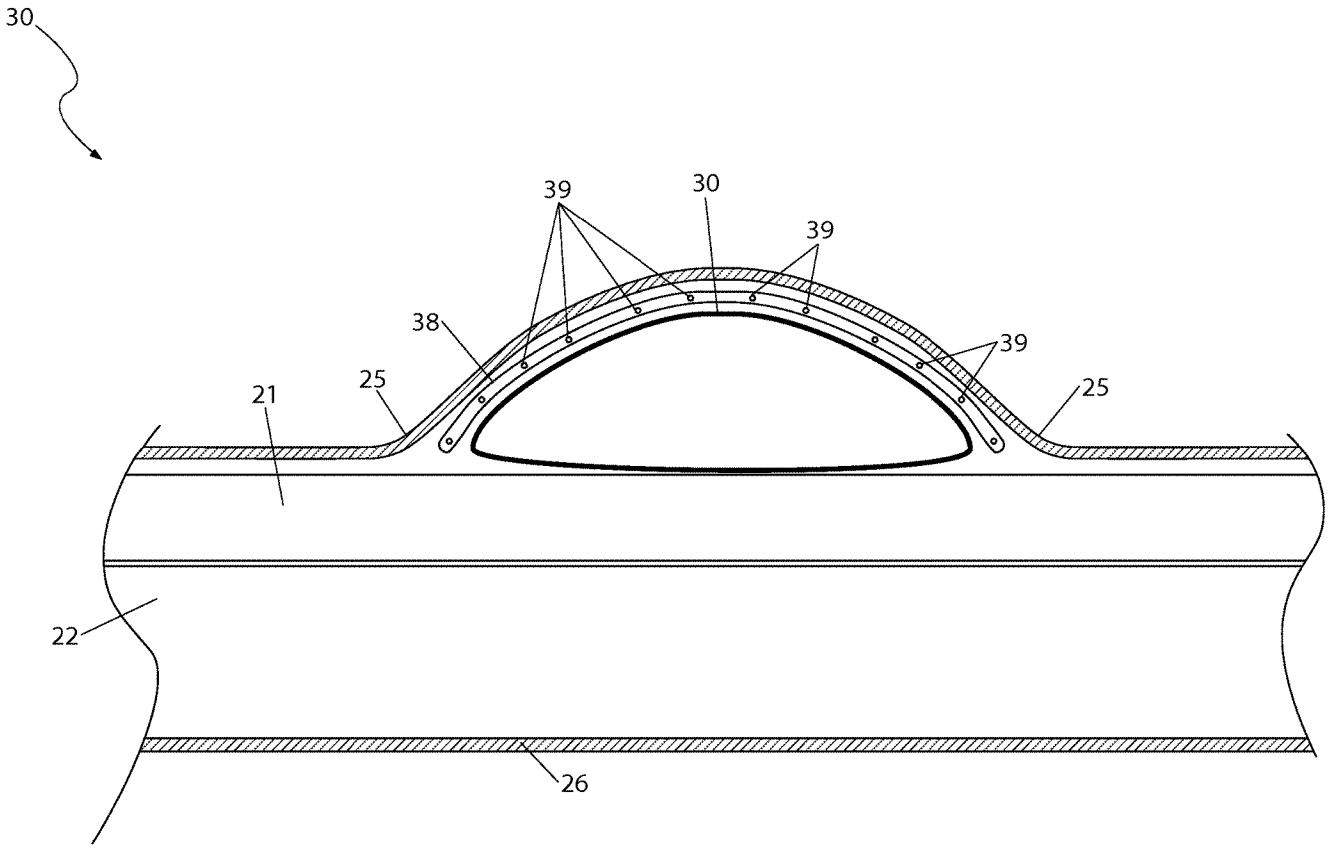
FIG. 3 depicts a section view of the mattress with inflatable lumbar support 10 taken along section line A-A (see FIG. 1), according to the preferred embodiment.

Referring now to FIG. 3, a section view of the apparatus 10 taken along section line A-A (see FIG. 1), according to the preferred embodiment, is disclosed. The inflatable tube 30 is integrated into a top surface of the mattress assembly 20 to form a laminated construction comprising, from top down, a top fabric panel 25, an electric blanket panel 38, the inflatable tube 30, a layer of top mattress padding 21, a layer of inner mattress padding 22, and a bottom fabric panel 26. The top 21 and inner 22 padding portion of the mattress assembly 20 are envisioned to be filled with various natural fibers, cushion-type materials, springs, or the like to provide a desired firmnesses for the occupant. The upper panel 25 and electric blanket panel 38 cover the inflatable tube 30 and are envisioned to be attached to an upper surface portion of said inflatable tube 30 via adhesives and/or conventional sewing techniques, yet other attachment methods may be utilized without limiting the scope of the apparatus 10. The top 25 and bottom fabric panels enclose the mattress assembly 20 in a conventional manner and are envisioned to be fabricated from common flame retardant synthetic or natural materials.

The inflatable tube 30 is envisioned to be fabricated from a rugged flexible inflatable material such as vinyl or rubber, yet other materials may be utilized without limiting the scope of the apparatus 10.

The electric blanket panel 38 is to be positioned between the top fabric panel 25 and said inflatable tube 30, and comprises a plurality of resistance wire heating elements 39 being entrapped within a fabric or synthetic blanket layer and arranged in a conventional parallel manner to provide a localized heating means.

Referring now to FIGS. 4 and 5, a close-up view and an electrical block diagram of a control module portion 50 of the apparatus 10, according to the preferred embodiment, are disclosed. Said control module 50 comprises a unitary plastic enclosure being recessed into a side surface of the mattress assembly 20 being adjacent to the head portion. Said control module 50 provides both a housing means and a mounting means to air and power portions of the air pump 51 and the electric blanket panel 38 via respective air pump control panel 52 and electric blanket control panel 60 portions. The electric air pump 51 is to be discretely housed within the control module 50. The air pump control panel 52 further comprises a two-position air switch 54 to selectively activate and deactivate said air pump 51, a digital air pressure display 55, and a vent valve 56. Said control module 50 further houses various electrical and electronic equipment necessary to operate the air pump 51 and also includes a pressure sensor 57 located downstream of the air pump 51 which provides a signal to said air pump control panel 52 which is in turn displayed upon the digital display portion 55, thereby enabling a user to inflate the inflatable tube 30 to a desired pressure in an accurate manner (see FIG. 5). The air switch 54 is illustrated here depicting a two-position sliding-type device; however, other switching devices may be provided with equal benefit such as a toggle switch, a rotary dial, or the like.

A length of common air tubing 70 interconnects the air pump 51 to the inflatable tube 30 being routed along a side surface of the mattress assembly 20 (see FIG. 1). The air pump 51 comprises a miniature AC powered fan-type blower or low-pressure vibratory compressor unit being similar to those commonly used to inflate air mattresses. The apparatus 10 comprises a manual air pump 33 which enables an alternate means to manually inflate the inflatable tube 30. Said manual air pump 33 comprises a spherical or bellows-type pumping device being pneumatically connected to the air tube 70 at an intermediate location, thereby providing air to said inflatable tube 30. The vent valve 56 comprises a hand-operated rotary knob and needle-valve device allowing a user to easily deflate the inflatable tube 30. Said vent valve 56 further provides a safety pressure relief function via a secondary pneumatic circuit having a spring-seated valving member to avoid possible damage to the inflatable tube 30 due to over inflation.

The control module 50 further provides an enclosure means to the electric blanket control panel 60 which further comprises an electric blanket switch 62 which provides a means to selectively activate and deactivate electric current to the heating element portions 39 within the electric blanket panel 38. Said electric blanket control panel 60 also provides a means to control an actual temperature of said electric blanket panel 38 via a rheostat-type temperature dial 64. Said electric blanket control panel 60 is envisioned to provide similar construction and functions as a conventional electric blanket controller. Electrical power from said electric blanket control panel 60 is conveyed to said electric blanket panel 38 via a wire 72 (also see FIG. 1).

Referring now to FIGS. 6 through 8, perspective, environmental, and sectional views of a portable inflatable tube embodiment 130, according to an alternate embodiment, are disclosed. The portable inflatable tube embodiment 130 comprises a detached portable inflatable tube portion 130 for enhanced use by a user 100. The portable inflatable tube 130 is a physically separate part and therefore may be removed from the mattress assembly 20 and be wrapped around various body areas of the user 100 such as waist, chest, legs, and the like, for therapeutic purposes. The portable inflatable tube 130 includes an encompassing fabric cover 125 which provides similar materials and function as the top fabric panel portion 25 of the preferred embodiment 10. The fabric cover 125 includes first hook-and-loop **132*a* and a second hook-and-loop 132*b* portions being sewn to, or otherwise affixed thereto end portions. The hook-and-loop portions 132*a*, 132*b* allow the portable inflatable tube portion 130 to be wrapped around the user 100 and selectively secured to itself to provide a desired fit. Additionally, the portable inflatable tube 130 includes a first quick disconnect plug 134*a* capable of providing a temporary means of detachment from the heating wire 72. A second quick disconnect plug 134*b* is capable of providing a temporary detachment from the inflating air tube 70 while isolating the air within the portable inflatable tube portion 130 when disconnected. These features allow a user 100 to move about freely while wearing the portable inflatable tube 130 allowing the user 100 to performing various duties as needed. Following the performance of one's duties, the quick disconnect plugs 134*a*, 134*b* may be reconnected to resume normal pneumatic and electrical functions as previously described above for the preferred embodiment 10**.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2.

The method of utilizing the apparatus 10 can be achieved by performing the following steps: acquiring the apparatus 10; positioning the apparatus 10 on a level surface, a bed frame, or other suitable surface for a mattress; inserting the power plug 66 into a household outlet; closing the vent valve 56 by rotating in a clockwise direction, if not previously closed; reclining upon the mattress assembly 20 with one's lower back area aligned with the inflatable tube 30; inflating the inflatable tube 30 by moving the air switch 54 to the "ON" position; allowing the pump 51 to run for a period of time until obtaining a desired firmness of the inflatable tube 30 against one's back or until the display 55 indicates a desired air pressure; stopping the air pump 51 by moving the air switch 54 to the "OFF" position; activating the electric blanket panel 38, if heated support is desired, by moving the electric blanket switch 62 to the "ON" position; adjusting the temperature of the electric blanket panel 38 by rotating the temperature dial 64 as needed to obtain a desired amount of heat within the inflatable tube 30; utilizing the apparatus 10 to sleep, rest, or to perform a therapeutic treatment to one's back area for a period of time; turning off the electric blanket panel portion 38 by moving the electric blanket switch 62 to the "OFF" position; deflating the inflatable tube 30 by rotating the vent valve 56 in a counter-clockwise direction; and, benefiting from improved heated or unheated lumbar support of one's lower back area afforded a user of the present invention 10.

The inflatable tube 30 may be alternately inflated using the manual air pump 33 based upon a user's preference or during such times as when electrical power is unavailable, or to "fine-tune" the firmness of the inflatable tube 30.

It is understood that the inflatable tube 30 may be deflated to a flattened state so as to allow the mattress assembly 20 to be utilized in an identical manner as that of a standard mattress when desired.

The method of utilizing the alternate portable inflatable tube embodiment 130 can be achieved by performing the following steps: procuring a model of the invention which includes the portable inflatable tube embodiment 130; lifting the portable inflatable tube portion 130 from the mattress assembly 20; wrapping the portable inflatable tube 130 around various body areas of the user 100 such as waist, chest, legs, and the like; securing the portable inflatable tube 130 in position by attaching the first hook-and-loop 132*a* and second hook-and-loop 132*b* portions together to obtain a desired fit; utilizing and controlling the pneumatic and heating functions of the invention as previously described; temporarily detaching the portable inflatable tube 130 from the inflating air tube 70 and heating wire 72, if desired, using the respective disconnect plugs 134*a*, 134*b*; allowing the user 100 to move about freely while wearing the portable inflatable tube 130; allowing the user 100 to performing various duties as needed; and, reconnecting the quick disconnect plug 134 to reestablish the normal pneumatic and electrical functions of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A mattress, comprising:

a mattress body having a top fabric layer, a top padding layer, an inner padding layer, a bottom fabric panel, a head end, and a foot end;

an electric blanket panel disposed under said top fabric layer;

an integral lumbar-supporting inflatable tube disposed between said electric blanket panel and said top padding layer, said inflatable tube disposed at an intermediate location of said mattress body, said inflatable tube defining a longitudinal axis oriented transversely across said mattress body, said electric blanket panel being positioned directly above said inflatable tube;

an air pump attached to said mattress body;

an air tube connecting said air pump to said inflatable tube, said air tube running along a vertical side of said mattress body from approximately the head end of the mattress body towards the foot end of the mattress body;

an air pump control panel for selectively controlling said air pump to supply air to said inflatable tube, the air pump control panel located near the head end of the mattress body on said vertical side;

an electric blanket control panel for controllably supplying electrical power to said electric blanket panel, the electric blanket control panel located adjacent the air pump control panel on said vertical side;

a manually operated pressure pump in fluid communication with said air tube and located along the air tube between the electric blanket control panel and the inflatable tube; and, electrical conductors for transferring electrical power from said electric blanket control panel to said electric blanket panel, said electrical conductors extending longitudinally alongside said air tube on the vertical side;

wherein said top fabric layer, said electric blanket panel, said inflatable tube, said top padding layer, said inner padding layer, and said bottom fabric panel form a laminated construction from a top external surface of the mattress body to a bottom external surface of the mattress body.

2. The mattress of claim 1, wherein said inflatable tube has an ovular cross-sectional shape when inflated.

3. The mattress of claim 1, wherein said inflatable tube has a semi-circular cross-sectional shape when inflated.

4. The mattress of claim 1, further including a housing assembly on said mattress body, said housing assembly housing said air pump control panel and said electric blanket control panel.

5. The mattress of claim 1, wherein said air pump has an AC powered fan.

6. The mattress of claim 1, further including a pressure sensor for sensing air pressure in said inflatable tube, where said air pump operates to keep said pressure sensor at a predetermined pressure.

7. The mattress of claim 1, wherein said top fabric layer, said top padding layer, said inner padding layer, said electric blanket panel, and said inflatable tube are glued together.

* * * * *